United States Patent [19]

Groskopfs

[11] 4,281,561

[45] Aug. 4, 1981

[54] THREE AXES CONTROLLER

[75] Inventor: Ernest Groskopfs, Caledon East, Canada

[73] Assignee: Spar Aerospace Limited, Weston, Canada

[21] Appl. No.: 82,864

[22] Filed: Oct. 9, 1979

[51] Int. Cl.[3] ..... G05G 9/04

[52] U.S. Cl. ..... 74/471 XY; 338/128

[58] Field of Search ..... 74/471 XY; 137/636.2; 200/6 A; 338/128

[56] References Cited

U.S. PATENT DOCUMENTS

| | | | |
|---|---|---|---|
| 3,188,879 | 6/1965 | Conley | 74/471 XY |
| 3,308,675 | 3/1967 | Jonsson | 200/6 A X |
| 3,795,882 | 3/1974 | Tokubo | 338/128 |
| 3,942,148 | 3/1976 | Nishioka | 74/471 XY |

*Primary Examiner*—Allan D. Herrmann

*Attorney, Agent, or Firm*—Fetherstonhaugh & Co.

[57] ABSTRACT

A three axes controller comprises a support platform in which a first carriage is mounted for movement in a first direction fore and aft of a first neutral position. A second carriage is mounted on the first carriage for movement in the direction of a second axis fore and aft of a second neutral position. A third carriage is mounted on the second carriage for movement in the direction of a third axis fore and aft of a third neutral position. Centering springs are provided for centering each carriage with respect to its neutral position. The first, second and third axes are orthogonally arranged and have a common origin when the carriages are in their neutral positions. A control lever is supported by a gimbal mounted on the first carriage at a point spaced from the proximal and distal ends thereof and a universal joint is provided at the distal end of the control lever for mounting the distal end on the third carriage. The control lever has a longitudinal axis aligned with the first axis when the carriages are in their neutral position and signalling devices are provided which are operative in response to movement of the various carriages to generate a signal proportional to the displacement of the carriages with respect to the member on which they are mounted for movement.

1 Claim, 4 Drawing Figures

THREE AXES CONTROLLER

FIELD OF INVENTION

This invention relates to three axes controllers. In particular, this invention relates to a three axes controller adapted to provide electrical signals proportional to the displacement of the control lever in the direction of each axis.

PRIOR ART

Considerable difficulty has been experienced in attempting to provide a simple and efficient three axes controller capable of generating independent signals in response to movement of the control lever in the direction of each axis while permitting a simultaneous movement of the control lever in the direction of each axis.

SUMMARY OF INVENTION

The present invention overcomes the difficulties of the prior art described above and provides a simple and efficient three axis controller capable of generating independent electrical signals proportional to the displacement of the control lever in the direction of each axis while permitting simultaneous displacement of the control lever in the direction of each axis.

According to one aspect of the present invention, there is provided a three axes controller which comprises a support platform, a first carriage, a first linear bearing mounting said first carriage on said support platform for movement in the direction of a first axis fore and aft of a first neutral position, first centering means normally urging said first carriage to said first neutral position, a second carriage, a second linear bearing mounting said second carriage on said first carriage for movement in the direction of a second axis fore and aft of a second neutral position, second centering means normally urging and second carriage to said second neutral position, a third carriage, a third linear bearing mounting said third carriage on said second carriage for movement in the direction of a third axis fore and aft of a third neutral position, a third centering means normally urging said third carriage to said third neutral position, said first, second and third axes being orthogonally arranged and having a common origin when said carriages are in said first, second and third neutral positions, a control lever having a proximal end and a distal end, gimbal means mounting said control lever on said first carriage at a point spaced from the proximal and distal ends of the control lever for gimballed movement relative to said first carriage while retaining said lever against longitudinal movement relative to said first carriage in the direction of said first axis, universal joint means at the distal end of said control lever mounting said distal end on said third carriage for universal movement with respect thereto in response to gimballed movement of the control lever, said universal joint having a center of gyration coincident with a common origin of the orthogonally arranged axes when the first, second and third carriages are located in their neutral position, said control lever having a longitudinal axis aligned with said first axis when said carriages are all in their neutral position whereby movement of the lever in a direction of its longitudinal axis effects movement of said first carriage in a direction of said first axis, first signal means having first and second components mounted on said support platform and said first carriage respectively, said first signal means being operative in response to movement of its first component with respect to its second component to generate an electrical signal proportional to the displacement of said first carriage with respect to said platform from said first neutral position, second signal means having first and second components mounted on said first carriage and said second carriage respectively, said signal means being operative in response to movement of one of its components relative to the other to generate an electrical signal proportional to the displacement of said second carriage with respect to said first carriage from said second neutral position, third signal means having first and second components mounted on said second and third carriages respectively, said third signal means being operative in response to movement of one of its components relative to the other to generate an electrical signal proportional to the displacement of said third carriage with respect to said second carriage from said third neutral position.

PREFERRED EMBODIMENT

The invention will be more clearly understood after reference to the following detailed specification read in conjunction with the drawings, wherein FIG. 1 is a partially sectioned pictorial view of a three axes controller constructed in accordance with one aspect of the present invention;

Figure 1:
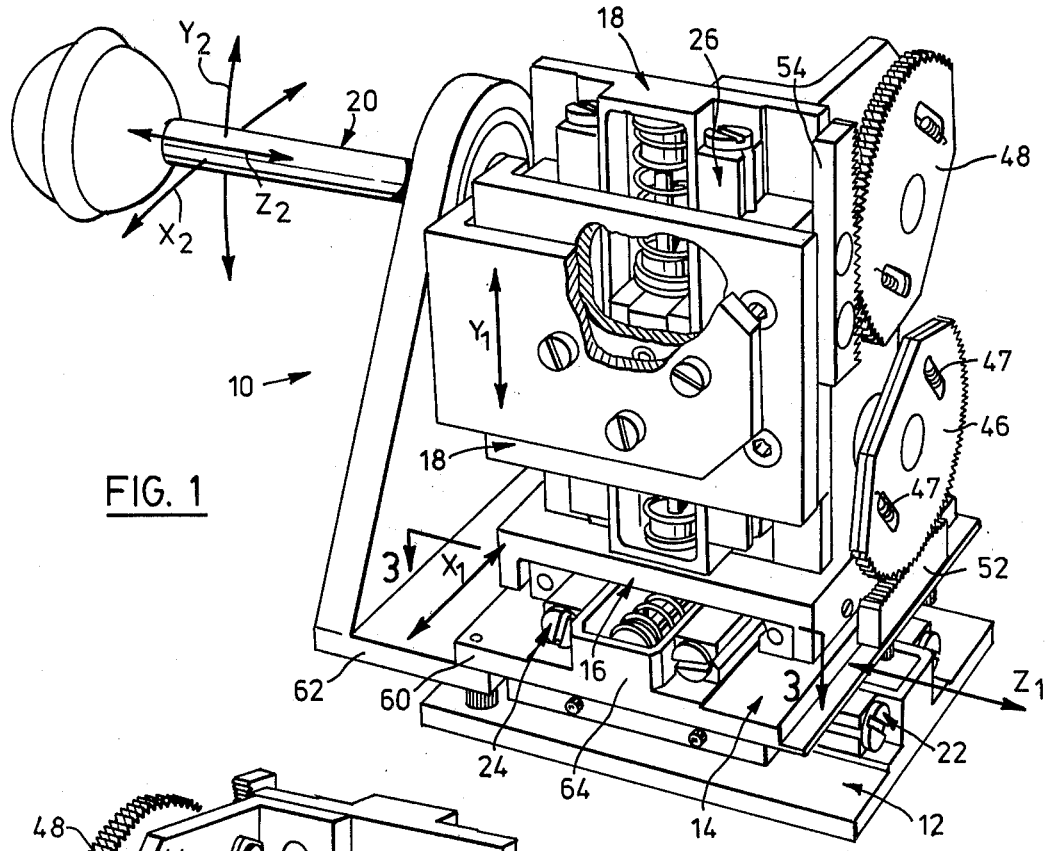
Figure 2:
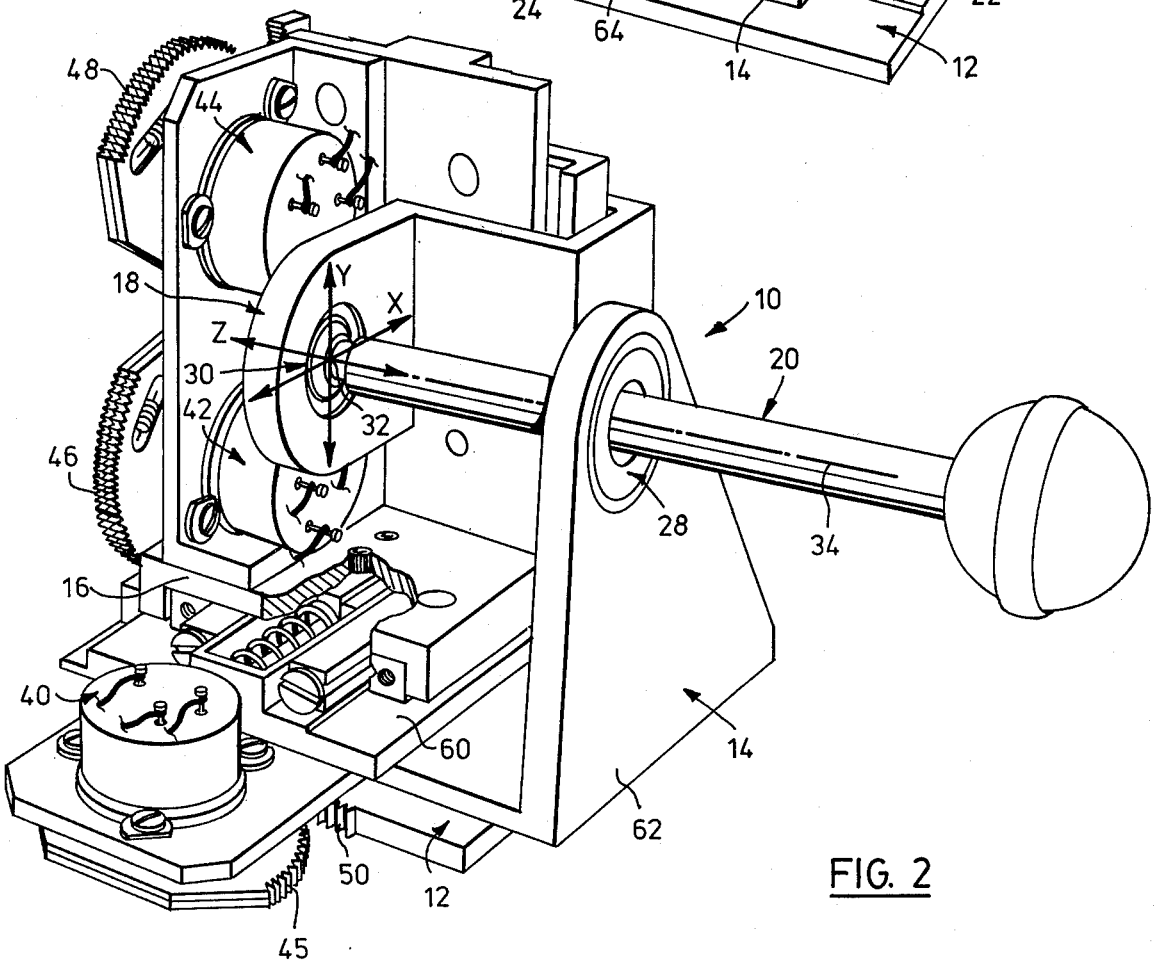
FIG. 2 is a partially sectioned pictorial view of the controller of FIG. 1 viewed from the opposite direction.

With reference to FIGS. 1 and 2 of the drawings, the reference numeral 10 refers generally to a three axes controller constructed in accordance with an embodiment of the present invention.

The principal members of the assembly are a platform 12, a first carriage 14, a second carriage 16, a third carriage 18 and a control lever 20.

The first carraige 14 is mounted for movement relative to the platform 12 in the direction of the axis Z1 by means of a linear bearing assembly 22. Similarly, the second carriage 16 is mounted for movement relative to the first carraige 14 in the direction of the axis X1 by means of a second linear bearing assembly, generally identified by the reference numeral 24. In addition, the third carriage 18 is mounted for movement relative to the second carriage in the direction of the axis Y1 by means of a third linear bearing assembly 26.

The control lever 20 is mounted in a gimbal support 28 carried by the first carriage 14. The lever arm is secured with respect to the gimbal mounting at a point spaced inwardly from the proximal and distal ends of the control lever.

A universal joint 30 is mounted in the third carriage 18 and serves to couple the distal end of the control lever to the third carriage 18 and permits universal movement of the distal end of the control lever with respect to the third carriage 18.

As will be described hereinafter, the first carriage 14 has a neutral position with respect to the platform 12, the second carriage 16 has a neutral position with respect to the first carriage 14 and the third carriage 18 has a neutral position with respect to the second carriage 16. When all of the carriages are in their neutral positions, the orthogonally arranged X, Y and Z axes have a common point of origin 32 at the center of gyration of the universal joint 30 and the longitudinal axis 34 of the control lever 20 is axially aligned with the Z axis.

In use, the lever arm 20 may be moved fore and aft of the neutral position in the direction of the arrows Z2 by effecting axial movement thereof with the result that the first carriage 14, together with the carriages which are mounted thereon, will be moved relative to the platform 12 in the direction of the Z axis. It will be noted that the second carriage is not caused to move relative to the first carriage and the third carriage is not caused to move relative to the second carriage when the lever arm is moved in the direction of the Z axis. Thus, movement of the first carriage with respect to the platform can be effected independent of movement relative to the second and third carriages.

Similarly, movement of the proximal end of the control lever 20 in the direction of the arrows X2 fore and aft of the neutral position will result in movement of the second carriage relative to the first carriage in the direction of the X axis without causing relative movement between the platform 12 and the first carriage 14 or relative movement between the second carriage 16 and third carriage 18.

In a like manner, movement of the distal end of the control lever 20 in the direction of the arrow Y2 fore and aft of the neutral position will result in movement of the third carriage 18 relative to the second carriage in the direction of the Y axis without effecting relative movement of the second carriage with respect to the third carriage or the first carriage with respect to the platform.

It will be noted that the first carriage 14 is restrained against movement relative to the platform 12 other than in the direction of the Z axis and the second carriage 16 is restrained against movement relative to the first platform 14 other than in the direction of the X axis and the third carriage 18 is restrained against movement relative to the second carriage 16 in a direction other than the direction of the Y axis. It will nevertheless be apparent that by reason of the provision of the gimbal mounting 28 and universal joint 32, the control lever 34 may be moved so as to be obliquely inclined with respect to the X and Y axes and may be displaced in the direction of the Z axis at the same time with the result that the first carriage may be displaced with respect to the platform 12 when the second carriage is also displaced with respect to the first carriage and when the third carriage is also displaced with respect to the second carriage. Thus, while the various components may be moved independently of one another, they may be simultaneously displaced with respect to one another from the neutral position.

Three electro-mechanical devices, generally identified by the reference numerals 40, 42 and 44, are provided for the purpose of generating an electrical signal proportional to the displacement of the first carriage, the second carriage and the third carriage relative to the neutral position. The electro-mechanical devices 40, 42 and 44 may be in the form of a potentiometer, LVDT, RVDT or any other suitable electro-mechanical device which produces an electrical signal proportional to displacement. In the preferred embodiment illustrated in FIGS. 1 and 2 of the drawings, the electromechanical devices 40, 42 and 44 have gear wheels 45, 46 and 48 mounted thereon to generate an electrical signal in response to rotation thereof. The first signal device 40 and its gear wheel 45 are supported by the first carriage 14, the second signal device 42 and the third signal device 44 and their associated gear wheels 46 and 48 are mounted on the second carriage 16.

A rack 50 is mounted on an edge of the platform 12 is engagement with the gear wheel 45 such that movement of the first carriage 14 relative to the platform 12 in the direction of the Z axis will cause displacement of the gear wheel 45 in an amount proportional to the linear displacement of the first carriage 14 with respect to the platform 12. Similarly, a rack 52 is mounted on the first carriage 14 in engagement with the gear wheel 46 and a rack 54 is mounted on the third carriage 18 in engagement with the gear wheel 48. Linear displacement of the second carriage with respect to the first carriage is measured by the signalling device 42 in response to rotation of the gear wheel 46 and linear displacement of the third carriage 18 with respect to the second carriage is measured by the signalling device 44 in response to rotation of the gear wheel 48.

As previously indicated, linear bearings 22, 24 and 26 serve to guide the movement of the carriages in a fixed linear direction. The linear bearing 24 and its associated centering mechanism which serves to guide and center the second carriage 16 with respect to the first carriage 14 will now be described in detail. The first carriage 14 includes a base portion 60 upon which a bracket 62 is mounted, the bracket 62 serving to support the gimbal bearing 28 as previously described. The base portion 60 is formed with a projection 64 which extends upwardly therefrom and extends longitudinally thereof. The projection 64 has a pair of oppositely disposed side walls 66 and a pair of end walls 68 which cooperate with one another to provide an enclosure 70. The linear bearing 24 includes a pair of first components 72 which are fixed with respect to the base portion 60 of the carriage and extend parallel to the side walls 66. Complementary linear bearing components 74 are mounted on the base portion 80 of the second carriage 16 and rollers 76 are located between the linear bearing members 72 and 74.

Figure 3:
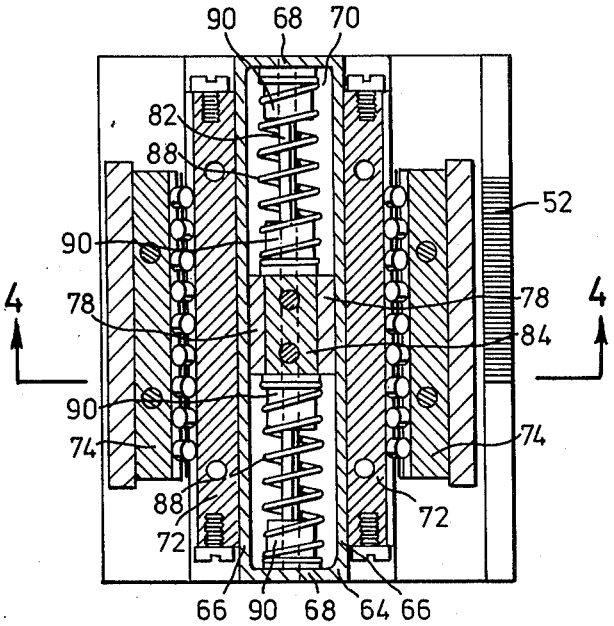
FIG. 3 is a sectional view taken along the line 3—3 of FIG. 1.
Figure 4:
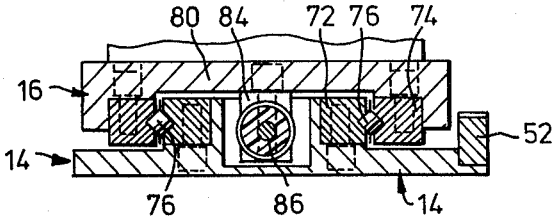
FIG. 4 is a sectional view taken along the line 4—4 of FIG. 3.

A pair of stop plates 78 are mounted in the channel 70 and secured with respect to the side walls 66 at opposite sides thereof centrally of the length of the channel 70. A shaft 82 has its opposite ends mounted in the end walls 68 and extends longitudinally of the channel 70 centrally of the width thereof. A slide block 84 is secured to the base 80 of the second carriage and has a passage 86 extending therethrough adapted to receive the shaft 82 in a close fitting sliding relationship so that the slide block 84 may move with the base 80. Centering of the second carriage 16 with respect to the first carriage 14 is achieved by means of a pair of compression springs 88 which are retained in position by oppositely disposed end caps 90. Deflection of the second carriage 16 with respect to the first carriage in the direction of the X axis causes the projection 84 to move toward one of the end walls 68 thereby compressing the spring 88 which is disposed therebetween. The other spring 88 will remain in the extended position illustrated in FIG. 3 being held by the spacer 78.

It will be understood that the first carriage 14 is mounted on the first platform 12 and the third carriage 18 is mounted on the second carriage 16 in the same manner as that described above with respect to the mounting of the second carriage 16 on the first carriage 14.

In order to eliminate backlash in the gears 45, 46 and 48, the gears are constructed as split gears with tension springs 47 extending therebetween to ensure that the teeth of the gears engage the teeth of their associated rack without backlash, thus serving to ensure that any movement of one of the moving components relative to the other is detected by the signal generating devices.

In use, movement of the control lever in the direction of the Z axis will cause the signalling device 40 to generate an electrical signal proportional to the displacement of the first carriage 14 with respect to the platform 12. Similarly, displacement of the control lever 34 in the direction of the X axis will cause the second signalling device 42 to generate an electrical signal proportional to the linear displacement of the second carriage 16 relative to the first carriage 14 and displacement of the control lever in the direction of the Y axis will cause the third signalling device 44 to generate an electrical signal proportional to the linear displacement of the third carriage with respect to the second carriage. It will also be apparent that any combination of the above movements of the control lever may be effected simultaneously so as to simultaneously generate electrical signals in each signal device, the signal in each case being proportional to the linear displacement of one moving component relative to its associated moving component.

What I claim as my invention is:

1. A three axes controller comprising;

a support platform, a first carriage, a first linear bearing mounting said first carriage on said support platform for movement in the direction of a first axis fore and aft of a first neutral position, first centering means normally urging said first carriage to said first neutral position, a second carriage, a second linear bearing mounting said second carriage on said first carriage for movement in the direction of a second axis fore and aft of a second neutral position, second centering means normally urging said second carriage to said second neutral position, a third carriage, a third linear bearing mounting said third carriage on said second carriage for movement in the direction of a third axis fore and aft of a third neutral position, a third centering means normally urging said third carriage to said neutral position, said first, second and third axes being orthogonally arranged and having a common origin when said carriages are in said first, second and third neutral positions, a control lever having a proximal end and a distal end, gimbal means mounting said control lever on said first carriage at a point spaced from the proximal and distal ends of the control lever for gimballed movement relative to said first carriage while retaining said lever against longitudinal movement relative to said first carriage in the direction of said first axis, universal joint means at the distal end of said control lever mounting said distal end in said third carriage for universal movement with respect thereto in response to gimballed movement of the control lever, said universal joint having a center of gyration coincident with the common origin of the orthogonally arranged axes when the first, second and third carriages are located in their neutral position, said control lever having a longitudinal axis aligned with said first axis when said carriages are all in their neutral position whereby movement of the lever in a direction of its longitudinal axis effects movement of said first carriage in a direction of said first axis, first signal means having first and second components mounted on said support platform and said first carriage respectively, said first signal means being operative in response to movement of its first component with respect to its second component to generate an electrical signal proportional to the displacement of said first carriage with respect to said platform from said first neutral position, second signal means having first and second components mounted on said first carriage and said second carriage respectively, said second signal means being operative in response to movement of one of its components relative to the other to generate an electrical signal proportional to the displacement of said second carriage with respect to said first carriage from said second neutral position, third signal means having first and second components mounted on said second and third carriages respectively, said third signal means being operative in response to movement of one of its components relative to the other to generate an electrical signal proportional to the displacement of said third carriage with respect to said second carriage from said third neutral position.

* * * * *